US010874564B2

(12) United States Patent
Splane et al.

(10) Patent No.: US 10,874,564 B2
(45) **Date of Patent: *Dec. 29, 2020**

(54) SEAT ASSIST DEVICE

(71) Applicant: SPLANE DESIGN ASSOCIATES, INC., Valley Center, CA (US)

(72) Inventors: Robson Lindsay Splane, Valley Center, CA (US); David A. Chen, Long Beach, CA (US)

(73) Assignee: SPLANE DESIGN ASSOCIATES, INC., Valley Center, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/917,146

(22) Filed: Mar. 9, 2018

(65) Prior Publication Data

US 2018/0325759 A1 Nov. 15, 2018

Related U.S. Application Data

(63) Continuation of application No. 14/846,008, filed on Sep. 4, 2015, now Pat. No. 9,918,886.

(60) Provisional application No. 62/070,815, filed on Sep. 8, 2014, provisional application No. 62/179,713, filed on May 18, 2015.

(51) Int. Cl.
*A61G 5/14* (2006.01)
*A47K 13/10* (2006.01)

(52) U.S. Cl.
CPC ..... *A61G 5/14* (2013.01); *A47K 13/105* (2013.01)

(58) Field of Classification Search
None
See application file for complete search history.

(56) References Cited

U.S. PATENT DOCUMENTS 3,259,427 A * 7/1966 Wiest ..... A61G 5/14 297/183.9
4,929,022 A * 5/1990 Geraci ..... A61G 5/14 297/183.9
5,346,280 A * 9/1994 Deumite ..... A61G 5/14 180/907
6,035,462 A * 3/2000 Bennett ..... A61G 7/1007 4/254
6,189,164 B1 * 2/2001 Krapu ..... A61G 5/14 297/313

(Continued)

FOREIGN PATENT DOCUMENTS

FR 2639807 A1 * 6/1990 ..... A61G 5/14

*Primary Examiner* — Brian E Glessner
*Assistant Examiner* — Adam G Barlow
(74) *Attorney, Agent, or Firm* — Risso I.P.

(57) ABSTRACT

A seat assist device is described. The seat assist device includes a base, a lift platform having a front portion and a rear portion, with the front portion of the lift platform being pivotally connected with the base. A lifting arm is connected with the rear portion of the lift platform. The lifting arm extends from the lift platform to project beyond the front portion of the lift platform, with the lifting arm terminating in handles for grasping by a user. A lift bar is pivotally connected between the base and the lifting arm, whereby a user sitting upon the seat assist device can press downward on the handles to cause the rear portion of the lift platform to rise and, in doing so, assist the user in rising from a seated position.

17 Claims, 19 Drawing Sheets

(56) References Cited

U.S. PATENT DOCUMENTS 6,199,228 B1 * 3/2001 Kallweit ..... A61G 5/1002 4/254
6,360,382 B1 * 3/2002 Karash ..... A61G 7/1007 4/667
7,247,128 B2 * 7/2007 Oga ..... A63B 21/00181 297/DIG. 10
8,646,123 B1 * 2/2014 Potvin ..... A47K 13/28 4/667
9,662,252 B1 * 5/2017 Pearson ..... A47K 17/026
2003/0011228 A1 * 1/2003 Komura ..... A61G 7/1019 297/344.12
2006/0284462 A1 * 12/2006 Cheng ..... A61G 7/1007 297/326
2007/0157376 A1 * 7/2007 Paz ..... A61H 33/02 4/540
2007/0173380 A1 * 7/2007 Gabel ..... A63B 21/00178 482/52
2010/0164268 A1 * 7/2010 Perk ..... A61G 5/12 297/344.12
2010/0264710 A1 * 10/2010 Lindsay ..... B60N 2/6009 297/313
2012/0181832 A1 * 7/2012 Lin ..... A61G 5/14 297/330
2013/0069407 A1 * 3/2013 Park ..... F16F 9/0209 297/313
2014/0103688 A1 * 4/2014 Wilson ..... A47C 1/03255 297/284.7
2014/0138995 A1 * 5/2014 Leib ..... A61G 5/14 297/283.2
2015/0018177 A1 * 1/2015 Oblak ..... A63B 23/0405 482/142
2016/0067125 A1 * 3/2016 Splane, Jr. ..... A61G 5/14 297/250.1
2016/0310334 A1 * 10/2016 Bliem ..... A47C 3/22
2016/0374879 A1 * 12/2016 Christian ..... A47C 1/029 297/313

* cited by examiner

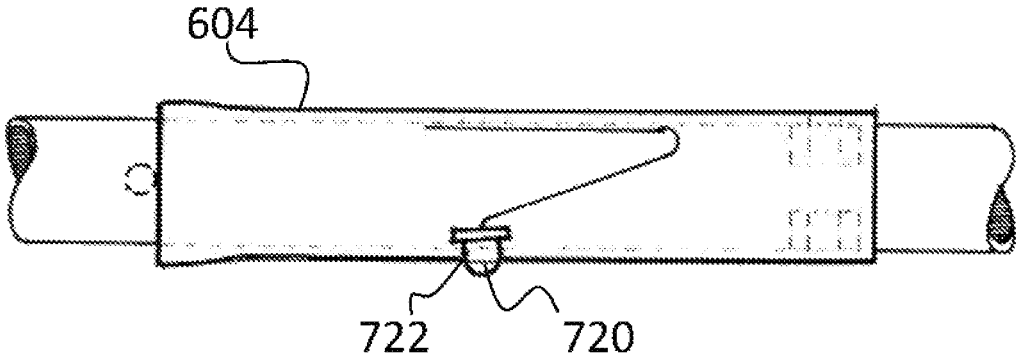
FIG. 7E
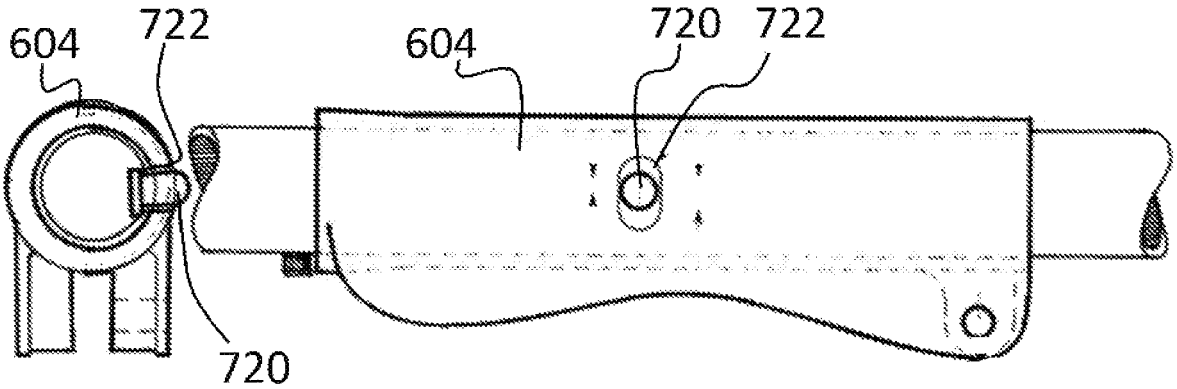
FIG. 7G
FIG. 7F

SEAT ASSIST DEVICE

CROSS-REFERENCE TO RELATED APPLICATIONS

This is a Continuation application of U.S. Non-Provisional application Ser. No. 14/846,008, filed on Sep. 4, 2015, which is a non-provisional application of U.S. Provisional Application No. 62/070,815, filed on Sep. 8, 2014, and of U.S. Provisional Application No. 62/179,713, filed on May 18, 2015.

BACKGROUND OF THE INVENTION

(1) Field of Invention

The present invention relates to a portable seat assist device and, more particularly, to a portable device that can be used with a broad range of furniture for assisting a user in lowering to a seated position and raising from the seated position.

(2) Description of Related Art

Seat assist devices have long been known in the art and are generally used to assist handicapped, overweight, and elderly individuals in sitting down and rising from a seated position.

Such seat assist devices are often designed as dedicated furniture pieces that provide a lifting function. For example, powered cushion chairs are commonly employed to provide the user with a desired seat assist action while also providing a comfortable furniture piece. Such powered cushion chairs typically operate through a powered lift actuator and scissor mechanism. During operation, the actuator and scissor mechanism lift and tilt the entire chair, thereby enabling a user to easily sit down and rise from the seated position. A problem with such dedicated furniture pieces is that they are large, expensive, and certainly not portable as they are incorporated into a single piece of furniture.

To address the need of cost and portability, a few devices have been conceived that are portable and can be used on a broad range of furniture. While smaller and portable, such portable devices are either powered or use a passive energy storing mechanism, such as springs. The powered options require electricity and some power source and, due to their powered mechanisms, are relatively expensive and have additional components prone to breakage. Alternatively, the spring-assisted seat devices require adjustment to match the spring forces to the weight of the occupant and, again, have several unreliable components.

Thus, a continuing need exists for a seat assist device that provides the ability to assist a user in sitting or rising solely based on the user's weight as opposed to some alternative power source.

SUMMARY OF INVENTION

The present invention is directed to a seat assist device. The seat assist device includes a base, a lift platform having a front portion and a rear portion, with the front portion of the lift platform being pivotally connected with the base. A lifting arm is connected with the rear portion of the lift platform. The lifting arm extends from the lift platform to project beyond the front portion of the lift platform, with the lifting arm terminating in handles for grasping by a user. A lift bar is pivotally connected between the base and the lifting arm, whereby a user sitting upon the seat assist device can press downward on the handles to cause the rear portion of the lift platform to rise and, in doing so, assist the user in rising from a seated position.

In another aspect, the seat assist device includes a slide slideably connected with the lifting arm, and wherein the lift bar is pivotally connected with the slide, thereby pivotally connecting the lift bar with the lifting arm.

In yet another aspect, the seat assist device includes a limit strap connected with and between the base and lifting arm, the limit strap operable for limiting upward motion of the rear portion of the lift platform.

In another aspect, the seat assist device includes pinch guards attached with the base, the pinch guards being positioned proximate the lift bar to prevent fingers from getting pinched between the lift platform and the base.

In another aspect, the seat assist device includes a slide stop attached with the lifting arm, the slide stop being a protrusion on the lifting arm to prevent forward motion of the slide.

Additionally, the slide is slideable between a folded position in which the slide is slid backwards along the lifting arm and a ready position in which the slide is drawn forward as the user lifts the handles.

In another aspect, the seat assist device includes a slide lock attaching with the lifting arm, the slide lock being formed to selectively lock the slide in place with respect to the lifting arm.

Further, the lifting arm is pivotally connected with the rear portion of the lift platform via a P-strap hinge.

In yet another aspect, the lift platform is shaped as a toilet seat.

In another aspect, the base further includes frame members formed to elevate the lift platform and position the lift platform over a toilet.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where:

FIG. 7E is a top-view illustration of the slide and slide lock, depicting the slide lock in a locked position;

FIG. 7F is a side-view illustration of the slide and slide lock, depicting the slide lock in a locked position;

FIG. 7G is a cross-sectional, front-view illustration of the slide and slide lock, depicting the slide lock in a locked position;

DETAILED DESCRIPTION

The present invention relates to a portable seat assist device and, more particularly, to a portable device that can be used with a broad range of furniture for assisting a user in lowering to a seated position and raising from the seated position. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of"step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
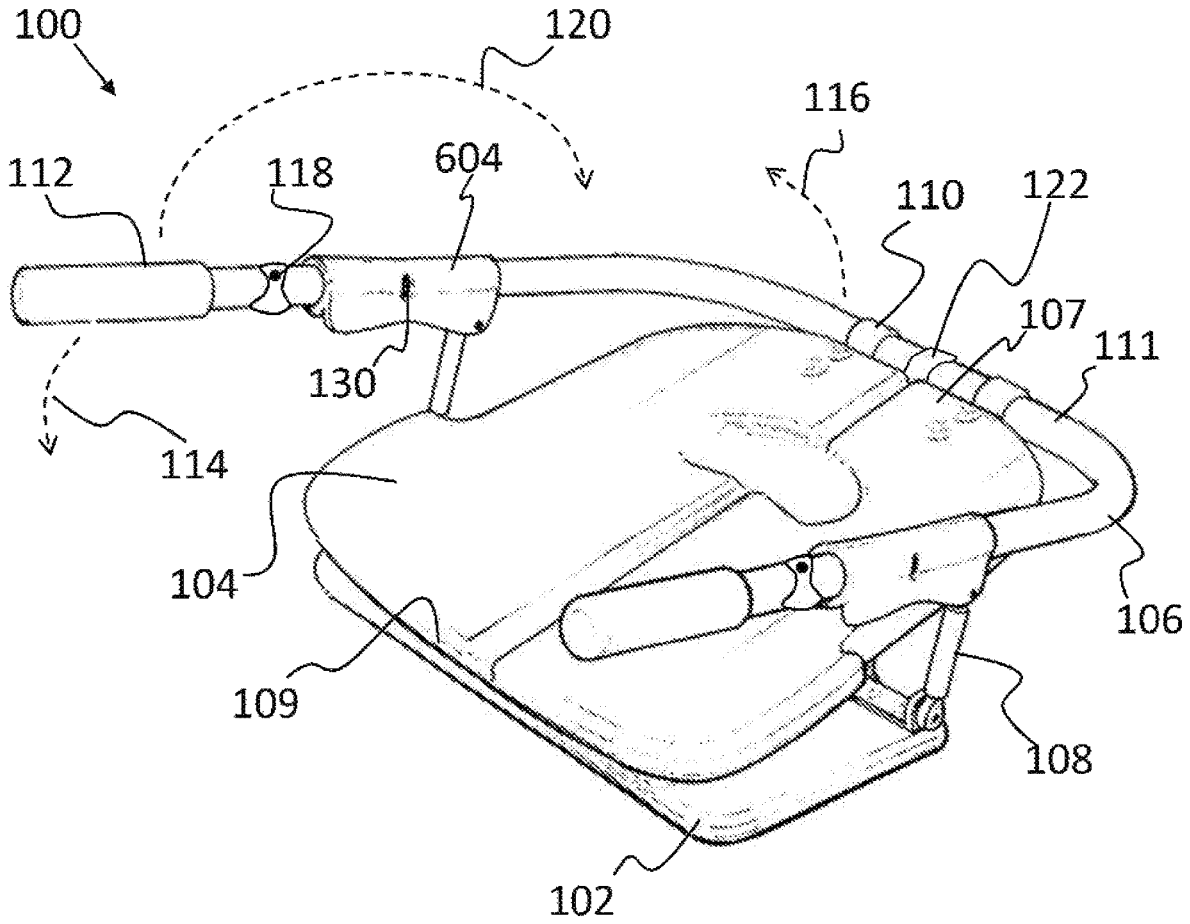
FIG. 1 is a perspective-view illustration of a seat assist device according to the principles of the present invention, depicting the seat assist device in a ready position.

Described is a seat assist device that can be used with a broad range of furniture for assisting a user in lowering to a seated position and rising from the seated position. To be contrasted with the prior art, the seat assist device described herein does not use any power or spring actuated mechanism to lower and lift the user. Instead and as will be apparent to the reader, the seat assist devices uses the user's own weight to control the lowering and lifting operations. As shown in FIG. 1, the seat assist device 100 includes a base 102 with a lift platform (e.g., seat) 104 pivotally connected with the base 102. For example, a continuous hinge or other any other suitable hinge device can be used to pivotally connect the lift platform 104 with the base 102.

The base 102 is any stable mechanism or device that provides a stable base from which the lift platform 104 can pivot. For example and as depicted, the base 102 can be formed as a metal frame, or as a plastic or metal panel. In other non-limiting examples and as described in further examples below, the base 102 can be the frame of a chair, a toilet bowl attachment, a chair frame for sliding over a toilet, or any other stable component. The lift platform 104 is any platform that is sufficiently strong to lift a user, a non-limiting example of which includes a plastic seat-shaped platform. Other non-limiting examples of suitable lift platforms 104 and as described in further examples below include the lift platform 104 being formed as a toilet seat and a chair seat (e.g., made of plastic, wood, metal, fiberglass, etc.).

Figure 7A:
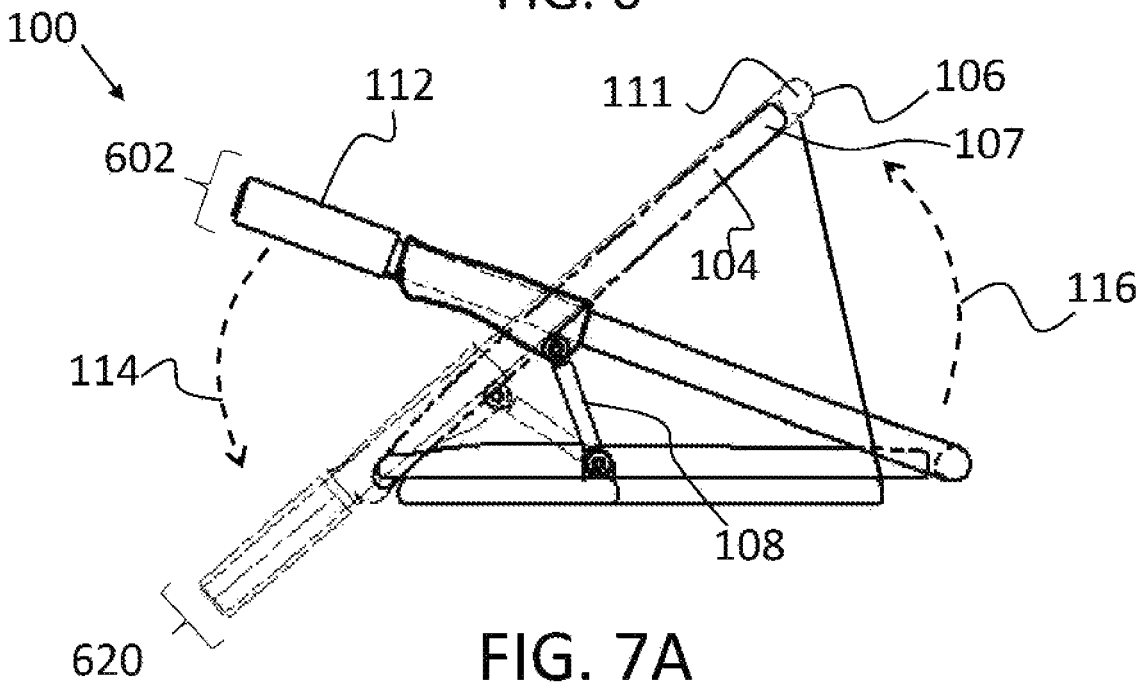
FIG. 7A is a side-view illustration of the seat assist device according to the principles of the present invention, depicting a transition of the seat assist device from the ready position to the lifted position.
Figure 7B:
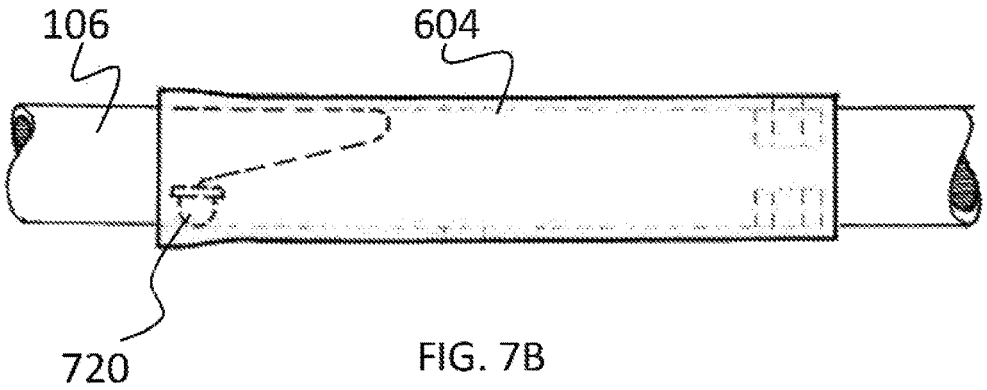
FIG. 7B is a top-view illustration of the slide and slide lock, depicting the slide lock in an unlocked position.
Figure 7D:
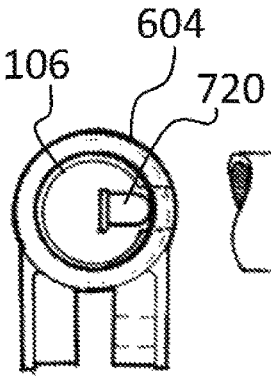
FIG. 7D is a cross-sectional, front-view illustration of the slide and slide lock, depicting the slide lock in an unlocked position.
Figure 7C:
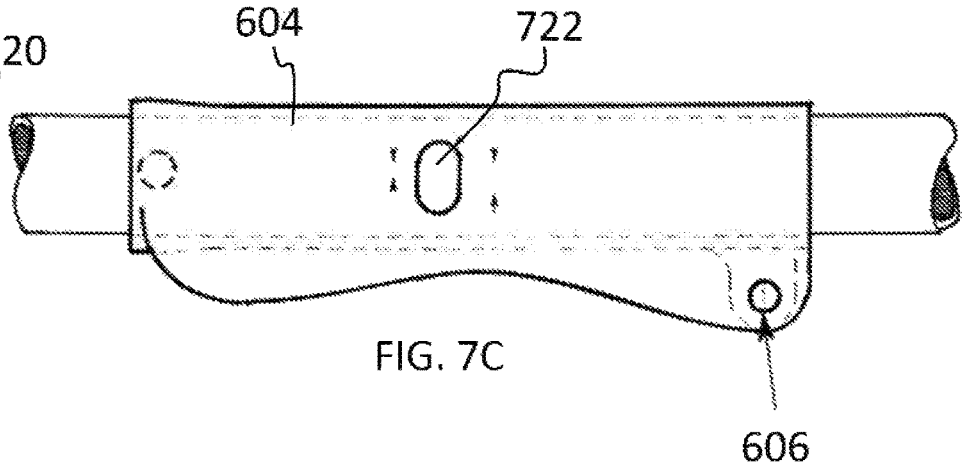
FIG. 7C is a side-view illustration of the slide and slide lock, depicting the slide lock in an unlocked position.
Figure 8A:
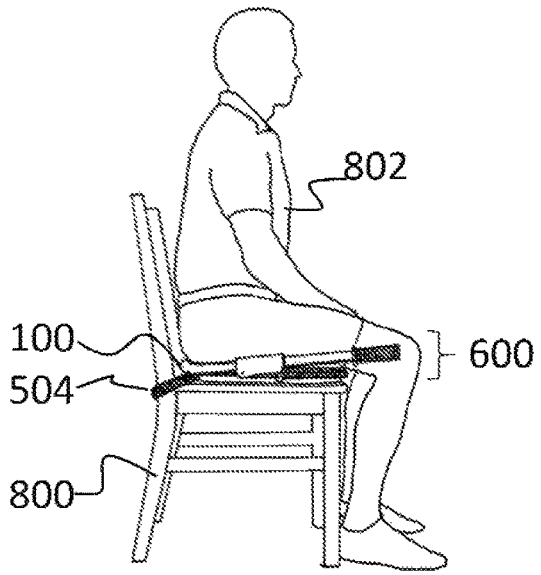
FIG. 8A is a side-view illustration of the seat assist device according to the principles of the present invention, depicting the seat assist device as positioned upon a chair in the folded position, with a user sitting thereon.
Figure 8B:
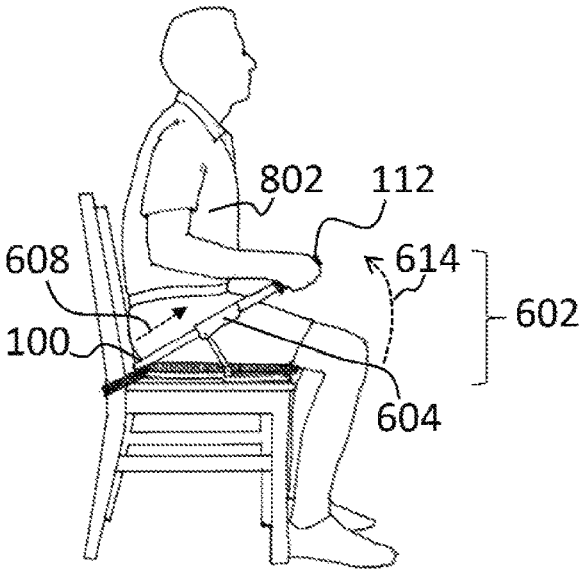
FIG. 8B is a side-view illustration of the seat assist device according to the principles of the present invention, depicting the seat assist device as positioned upon a chair in the ready position, with the user sitting thereon and grasping handles of the seat assist device.
Figure 8C:
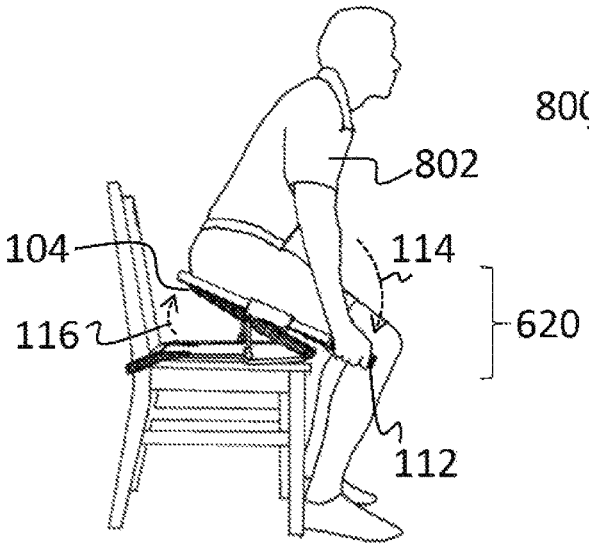
FIG. 8C is a side-view illustration of the seat assist device according to the principles of the present invention, depicting the seat assist device as positioned upon a chair, with the user pressing down upon the handles to transition the seat assist device from the ready position to the lifted position.

A lifting arm 106 is connected with the lift platform 104 to lift the lift platform 104 from a ready position (as depicted in FIG. 8B) to a lift position (as shown in FIGS. 5, 7, and 8C).

In some embodiments, the lifting arm 106 is connected with a rear portion 107 of the lift platform 104 to lift the rear portion 107 and, in doing so, tilt the lift platform 104 to the lift position. The lifting arm 106 is connected with the rear portion 107 using any suitable mechanism or device for connecting two components. For example and in some embodiments, a pivotal connector 110 is included that provides for a pivotal connection between a rear section 111 of the lifting arm 106 and the rear portion 107 of the lift platform. A non-limiting example of such a pivotal connector 110 includes a P-Strap Hinge that pivots around the lifting arm 106 and is thru-bolted to the lift platform 104.

The lifting arm 106 extends around or otherwise from the lift platform 104 to project beyond a front portion 109 of the lift platform 104. The lifting arm 106 terminates in handles 112 for grasping by a user. In some embodiments, the handles 112 are optionally pivotally connected with the lifting arm 106 (via a pivotal connector 118, such as a hinge, bolt, etc.) to allow the handles 112 to be rotated 120 out of position and out of the way when not in use. By rotating 120 the handles 112 back on top of the lifting arm 106, the handles 112 no longer extend from the seat assist device 100 and, as such, do not provide an obstruction to positioning of the device 100. For example, if the seat assist device 100 were placed on a common wheelchair seat, the handles 112 could prevent the wheelchair from being positioned next to and partially under a dining table. By rotating 120 the handles 112 out of position and over the lifting arm 106, such a wheelchair could still be easily positioned next to a dining table, thereby increasing its utility and comfort for the user. It should be understood that there are other techniques by which the handles 112 can be selectively moved or reduced in size, non-limiting examples of which include telescoping handles, or handles 112 that swing out and around laterally instead of rotating 120 on top of the lifting arm 106.

Pivotally connected between the base 102 and lifting arm 106 is a lift bar 108. In some embodiments, the lift bar 108 is connected with the base 102 and lifting arm 106 such that it is positioned between the front portion 109 and rear portion 107 of the lift platform 104 to provide a fulcrum about which the lifting arm 106 pivots. Thus, by pressing downward 114 on the handles 112, the rear section 111 of the lifting arm 106 is forced upwards 116, which in turn lifts the rear portion 107 of the lift platform 104 to the lift position. It should be noted that although term "bar" is used for the lift bar 108, the invention is not strictly limited to a "bar" (e.g., metal pipe), as any other suitably shaped item can be used to provide the fulcrum effect of the lift bar 108. Thus, although in some embodiments the lift bar 108 is an actual bar shaped item, in other embodiments the lift bar 108 can be any other suitably shaped item to provide the fulcrum action, such as a pyramid or pie shaped item, etc.

To prevent the lift platform 104 from over extending when in the lift position, any suitable limiter can be included. For example, a limit strap 122 (e.g., one inch flat nylon webbing, etc.) can be connected (via screws, strapping around, etc.) with and between the base 102 and lifting arm 106. The limit strap 122 operates to limit the upward motion of the rear portion 107 of the lift platform 104. These aspects are further depicted in FIG. 5A.

Figure 2:
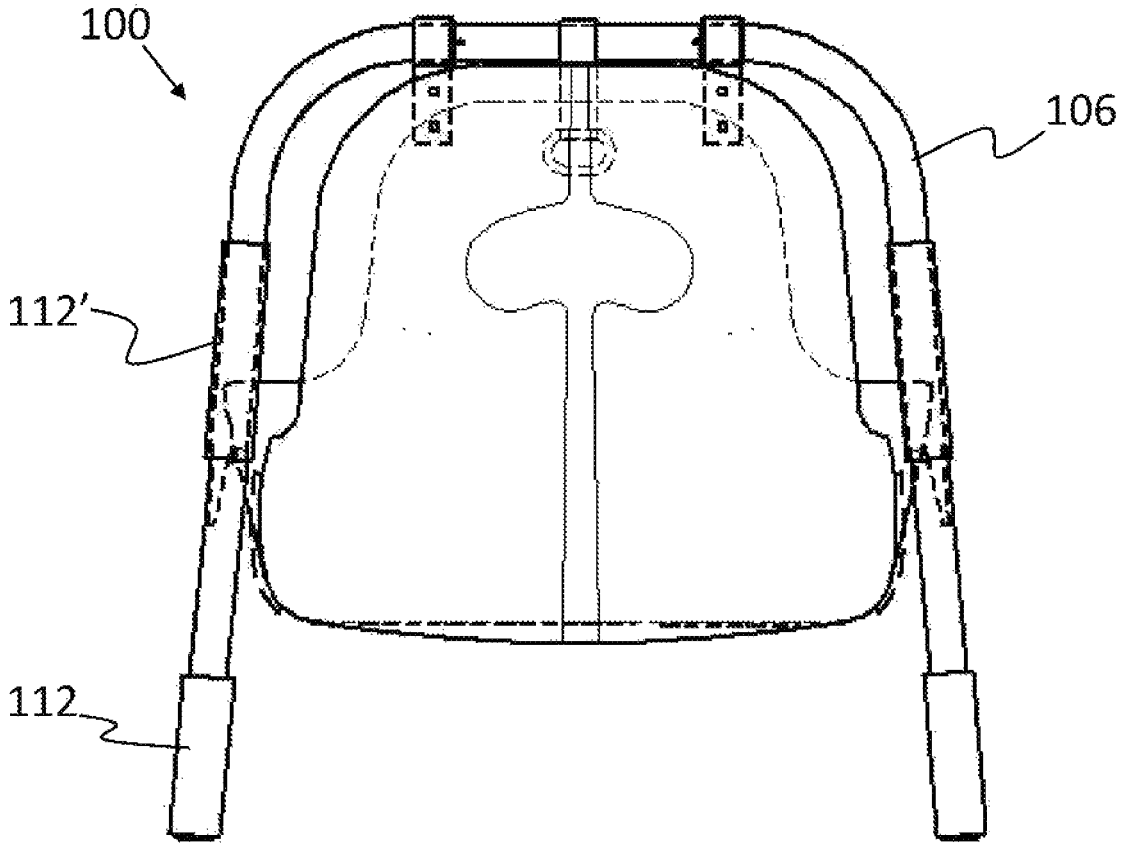
FIG. 2 is a top-view illustration of the seat assist device according to the principles of the present invention, depicting the seat assist device in a folded position.

For further understanding, FIG. 2 provides a top-view illustration of the seat assist device 100, depicting the seat assist device 100 in a folded position. As noted above, the handles 112, in some embodiments, are formed to rotate out of position and out of the way when not in use. For example and for illustrative purposes, FIG. 2 illustrates the handles 112 as folded out into a use position, as well as being folded (i.e., folded handles 112') back over the lifting arm 106.

Figure 3:
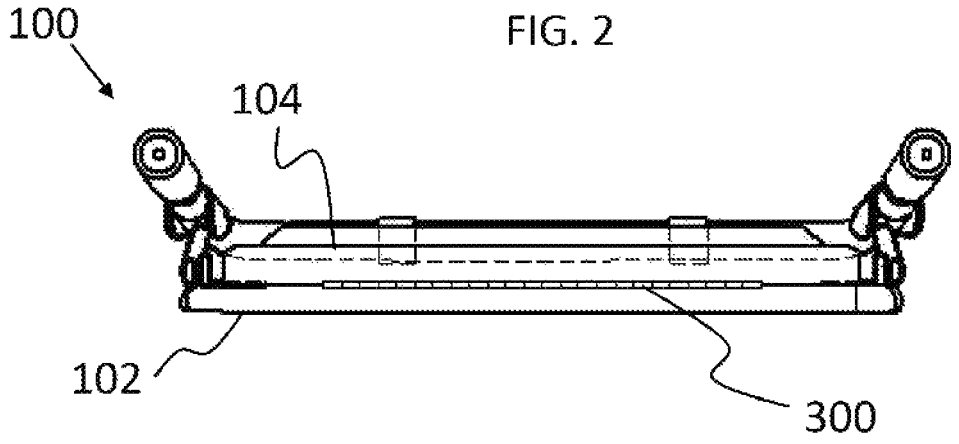
FIG. 3 is a front-view illustration of the seat assist device according to the principles of the present invention, depicting the seat assist device in the folded position.

FIG. 3 is a front-view illustration of the seat assist device 100, depicting the seat assist device 100 in the folded position. As noted above, the lift platform 104 is pivotally connected with the base 102 using a hinge device, such as the continuous hinge 300 (as depicted in FIG. 3). Also as noted above, the pivotal connection allows the lift platform 104 to go from the folded position to the lift position.

Figure 4:
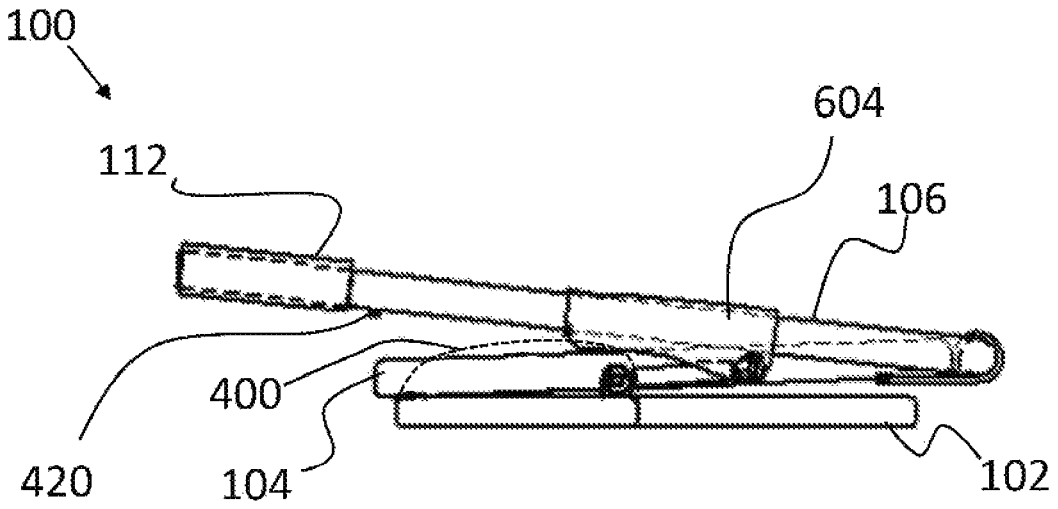
FIG. 4 is a side-view illustration of the seat assist device according to the principles of the present invention, depicting the seat assist device in the folded position.

For example, FIG. 4 is a side-view illustration of the seat assist device 100, depicting the seat assist device in a mostly folded position, with the handles 112 and lifting arm 106 lifted slightly for illustrative purposes. The seat assist device 100 optionally includes pinch guards 400 that are attached with the base 102 and positioned to prevent fingers from inadvertently getting pinched between the lift platform 104 and the base 102. Although depicted as transparent for illustrative purposes, it should be understood that the pinch guards 400 are solid components formed to prevent fingers from passing into the seat device 100 and between the lift platform 104 and the base 102. As a non-limiting example, the pinch guards 400 are plastic shields that are clipped onto or otherwise affixed with the base (via glue, screws, molding (i.e., molded with the base) etc.).

Figure 5A:
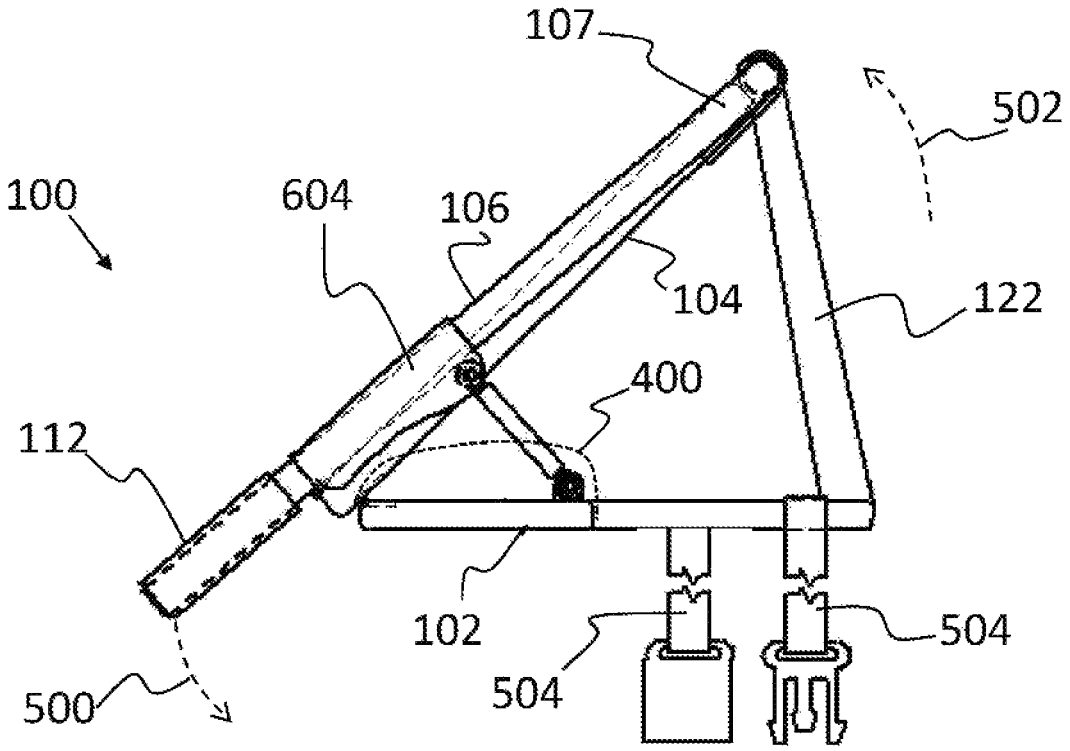
FIG. 5A is a side-view illustration of the seat assist device according to the principles of the present invention, depicting the seat assist device in a lifted position.

The pinch guards 400 are also shown in FIG. 5A, which is a side-view illustration of the seat assist device 100, depicting the seat assist device 100 in a lifted position. Also shown is a limit strap 122 which limits the upward motion 502 of the rear portion 107 of the lift platform 104.

In some embodiments and as shown in FIG. 5A, the seat assist device 100 is a portable device that can be easily affixed with another item such as a chair or wheelchair. In doing so, it is desirable to secure the seat assist device 100 against such a chair using any suitable mechanism or device that allows an operator to selectively affix the portable seat assist device 100 against the chair. As a non-limiting example, a connector mechanism can be included that extends from the base 102 for securing against the chair. As yet another non-limiting example, the connector mechanism is a pair of strap fixtures 504, with the strap fixtures 504 connectable with one another via, for example, male/female connectors, or any other suitable mechanism or device.

Figure 5B:
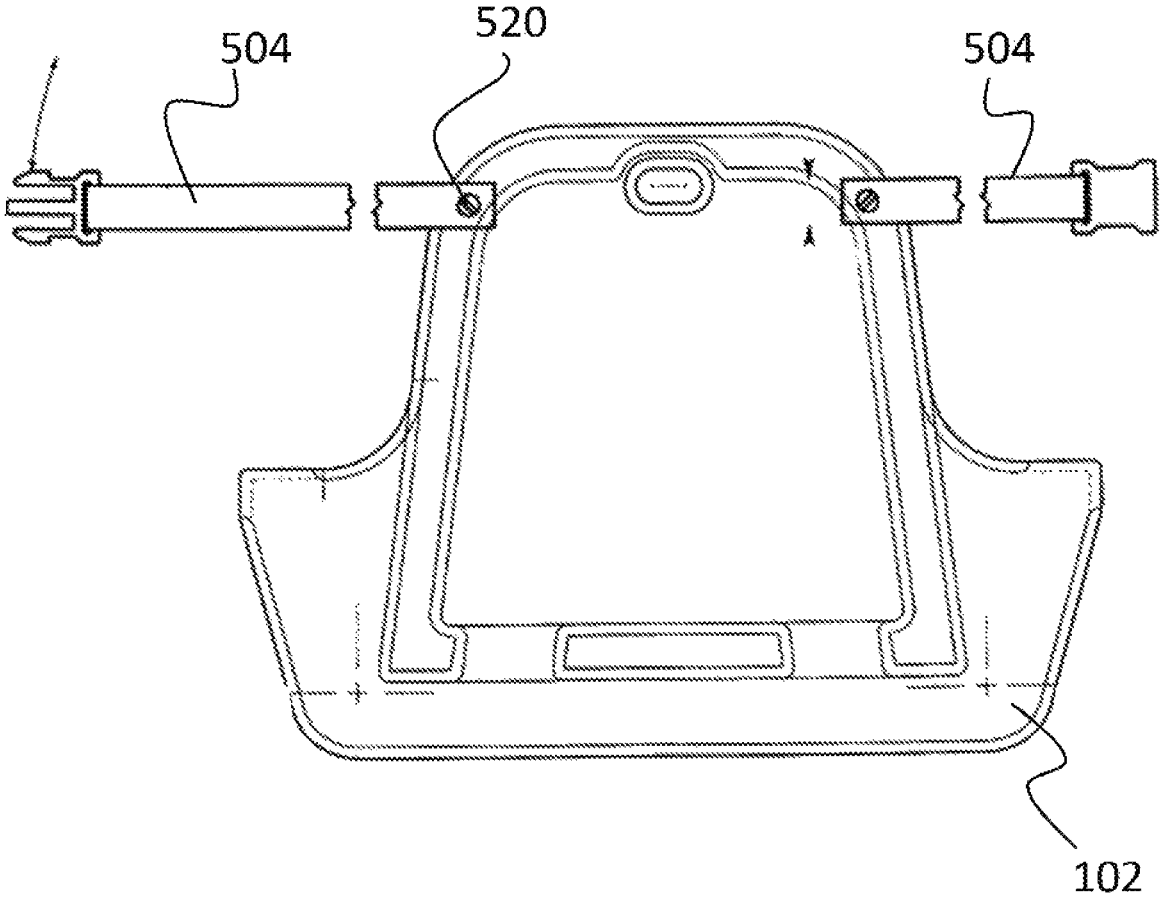
FIG. 5B is a plan-view illustration of the base, depicting strap fixtures connected with the base.

FIG. 5B, for example, depicts the base 102 with the pair of strap fixtures 504. In some embodiments, the strap fixtures 504 are affixed with a screw 520 or rivet that allow the strap fixtures 504 to pivot. As noted above, the strap fixtures 504 can be used to affix the seat assist device 100 with a chair. The strap fixtures 504 can also be employed as a safety belt for a user and can act as a carry strap during transport.

As noted above, the seat assist device 100, in some embodiments, is operable for transitioning between the folded position to the ready position, and from the ready position to the lifted position. These aspects are further illustrated in FIGS. 6 and 7A.

Figure 6:
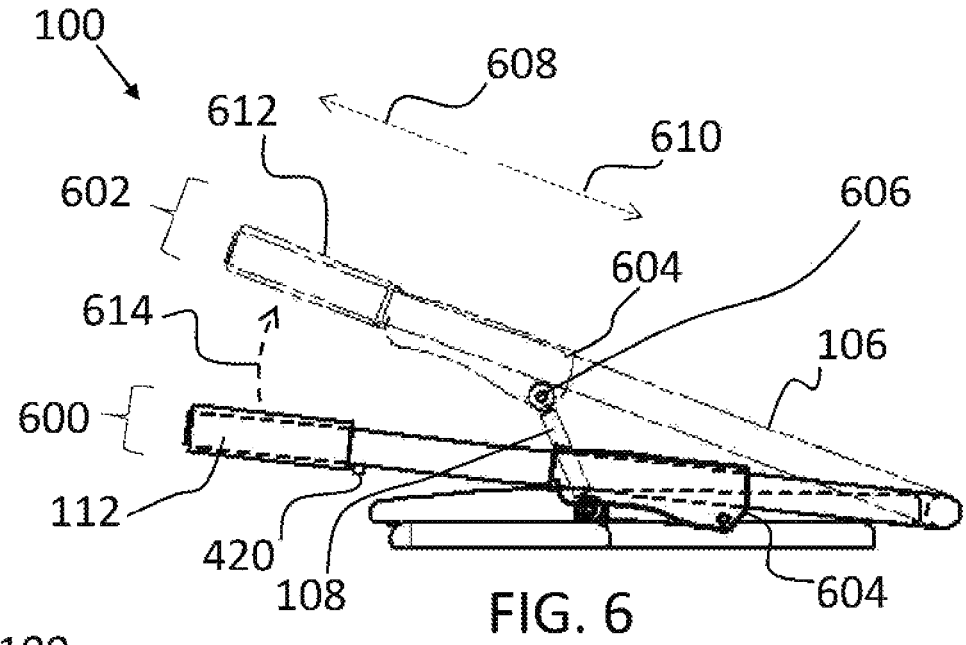
FIG. 6 is a side-view illustration of the seat assist device according to the principles of the present invention, depicting a transition of the seat assist device from the folded position to the ready position.

FIG. 6, for example, is a side-view illustration of the seat assist device 100, depicting a transition of the seat assist device 100 from the folded position 600 to the ready position 602. In some embodiments a slide 604 is included. The slide 604 is slideably connected with the lifting arm 106 to provide for a sliding motion along a length of the lifting arm 106. Importantly, the lift bar 108 is pivotally connected with the slide 604 on one end (which in effect pivotally and slideable connects the lift bar 108 with the lifting arm 106) and pivotally connected with the base 102 on the other end. The slide 604 is any suitable mechanism or device that is operable for allowing a connection point 606 of the lift bar to slide forward 608 and backward 610 with respect to the lifting arm 106. As a non-limiting example, the slide 604 is a sleeve (e.g., plastic, metal, etc.) having a cylindrical hole therethrough that is positioned around a portion of the lifting arm 106 to allow the slide 604 to slide forward 608 and backward 610. Thus, when in the folded position 600, the slide 604 is retracted (slid) toward the rear of the seat assist device 100. To transition from the folded position 600 to the ready position 602, the handles 112 are lifted up 614 which draws the slide 604 forward 608. The slide 604 continues until it reaches a slide stop 420 (also depicted in FIG. 4). The slide stop 420 is any suitable mechanism or device operable for limiting the forward 608 motion of the slide 604, non-limiting examples of which include a protrusion formed proximate the handle 112 to engage with the slide 604, or handle grips 612. As depicted in FIG. 1, the slide 604 optionally includes a slide lock 130, which is any suitable locking mechanism such as a locking detent tab or any other suitable locking device. Thus, in some embodiments the slide 604 merely stops at the slide stop 420 (such as a protrusion or other stop device), whereas in some other embodiments, the seat assist device 100 includes a slide stop 420 instead of or in conjunction with a slide lock 130. The slide lock 130, for example, includes holes on at least one side of the slide 604 with a locking detent that is depressed underneath the slide 604. As the holes on the slide 604 align with the locking detent, the locking detent springs out to engagingly lock with the slide 604.

This is further illustrated in FIGS. 7B through 7G. Specifically, FIG. 7B is a top-view illustration of the slide 604 and slide lock, depicting the slide lock in an unlocked position. As shown, the slide lock includes a spring-loaded detent 720 positioned within the lifting arm 106. In the side-view illustration of FIG. 7C, it is shown that the slide lock includes a hole 722 formed through the wall of the slide 604. Also shown is a hole formed through the slide 604 which serves the connection point 606 for the lift bar. For example, a dowel pin can be used to secure the lift bar with the connection point 606, thereby pivotally connecting the lift bar with the slide 604. A similar dowel pin can optionally be used on the other end of the lift bar to pivotally connect the lift bar with the base.

Referring again to the slide lock, FIG. 7D provides a cross-sectional, front-view illustration of the slide 604 and slide lock, depicting the spring-loaded detent 720 compressed within the lifting arm 106.

As a user slides the slide 604 into position, the spring-loaded detent 720 is allowed to pass through the hole 722 and lock the slide 604 in place. This is further depicted in FIG. 7E through 7G. Specifically, FIGS. 7E, 7F, and 7G, are a top-view, side-view, and cross-sectional front view illustrations, respectively, depicting the spring-loaded detent 720 as having passed through the hole 722 to lock the slide 604 in place.

Referring again to FIG. 6, once the handles 112 are lifted and the slide 604 is stopped, the seat assist device 100 is now ready for lifting or lowing a user (i.e., the ready position 602).

FIG. 7A is a side-view illustration of the seat assist device 100, depicting a transition of the seat assist device 100 from the ready position 602 to the lift position 620. As noted above, by pressing downward 114 on the handles 112, the rear section 111 of the lifting arm 106 is forced upwards 116, which in turn lifts the rear portion 107 of the lift platform 104 to the lift position 620 due to the fulcrum provided by the lift bar 108. Also shown is the limit strap 122 which limits upward 116 motion of the lifting arm 106 and lift platform 104.

For further understanding, FIGS. 8A through 8D illustrate the seat assist device 100 in operation with a user, transitioning from the folded position 600 to the lift position 620. FIG. 8A, for example, depicts the seat assist device 100 as positioned upon a chair 800 in the folded position 600, with a user 802 sitting thereon. Note that the seat assist device 100 is strapped to the chair 800 via the strap fixture 504.

As shown in FIG. 8B, as the user 802 lifts 614 the handles 112, the slide 604 is drawn forward 608 until it reaches the stop position via the slide stop. At that point the seat assist device 100 is in the ready position 602.

Figure 8D:
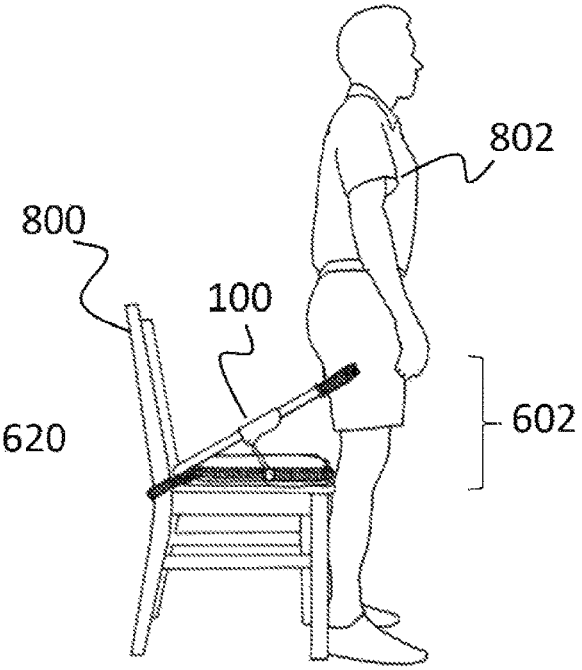
FIG. 8D is a side-view illustration of the seat assist device according to the principles of the present invention, depicting the seat assist device as positioned upon a chair in the ready position after having lifted a user.

As shown in FIG. 8C, when the user 802 presses downward 114 upon the handles 112, the lift platform 104 is forced upwards 116 to the lift position 620, from which the user can stand, as shown in FIG. 8D. Specifically, FIG. 8D depicts the seat assist device 100 as positioned upon the chair 800 in the ready position 602 after having lifted the user 802. Thus, the user 802 can then be lowered into a sitting position using a reverse order of the process depicted in FIGS. 8A through 8C.

Figure 9:
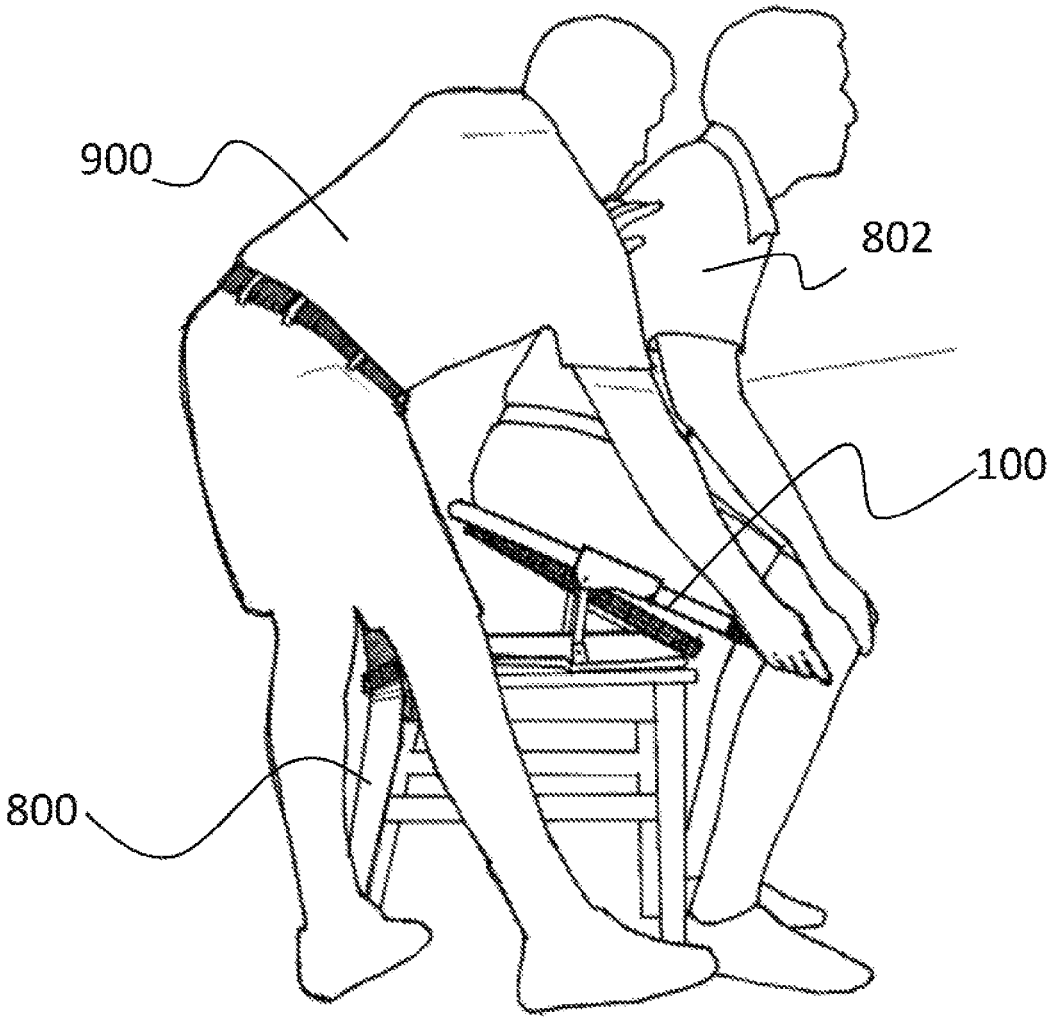
FIG. 9 is an illustration depicting an aspect by which the seat assist device as actuated by a caregiver to assist a user in rising from a chair.

It should be noted that the seat assist device 100 can be used and implemented in a variety of applications according to the principles of the present invention. For example, FIG. 9 is an illustration depicting an aspect by which the seat assist device 100 is actuated by a caregiver 900 to assist the user 802 in rising from a chair 800.

Figure 10:
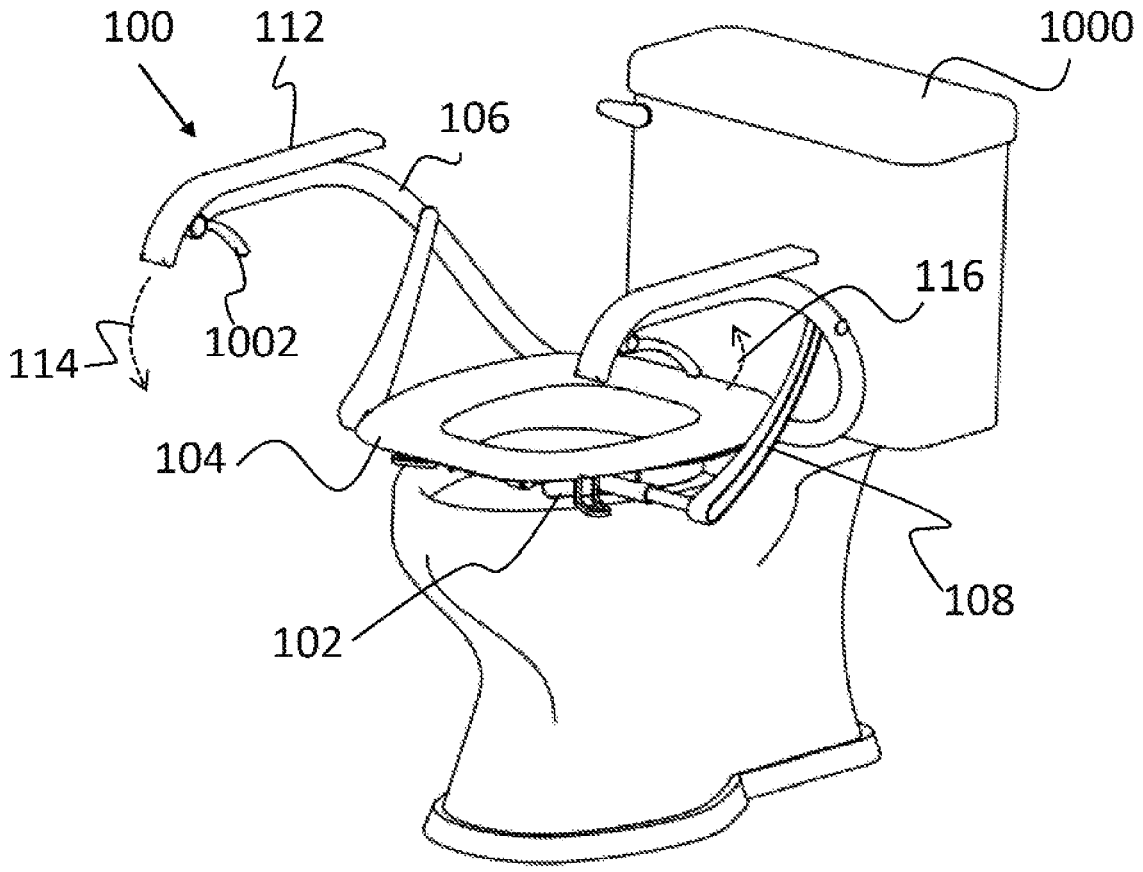
FIG. 10 is an illustration of the seat assist device according to the principles of the present invention, depicting an aspect in which the seat assist device is incorporated into a toilet seat.

As yet another example, FIG. 10 is an illustration depicting an aspect in which the seat assist device 100 is incorporated into a toilet seat to lift a user off of a toilet 1000. In this aspect, for example, the lift bar 108 is optionally fixed in the ready position while the lift platform 104 is formed in the shape of an actual toilet seat (with a hole therethrough)

to operate as a functional toilet seat. The base 102 can be formed and shaped to coincide with the shape of the toilet bowl and bolt or otherwise be affixed with the toilet bowl. For example, the base 102 can have bolts or bolt holes that align with the toilet seat bolt holes on an actual toilet, thereby allowing a user to easily affix such a device with a toilet in place of a traditional toilet seat. The lifting arms 106 can be formed as depicted to operate handles 112. As was the case above, pushing downward 114 on the handles 112 causes the rear portion of the lift platform 104 (i.e., toilet seat) to lift upward 116. Optionally included in this and any other aspect is a locking device 1002. The locking device 1002 is any suitable mechanism or device that is operable for locking the seat assist device to prevent transition between the various positions (in this example from the ready to lift position). As a non-limiting example, the locking device 1002 includes brake levers with cables that run through the lifting arms 106 and connect with a latch that is detachably attachable with a corresponding catch on the rear of the lift platform 104. For example, if a user was to squeeze the lever, the latch would withdraw from the catch, allowing the user to press downward 114 upon the handles 112; otherwise the lifting arms are locked in the ready position as depicted.

Figure 11:
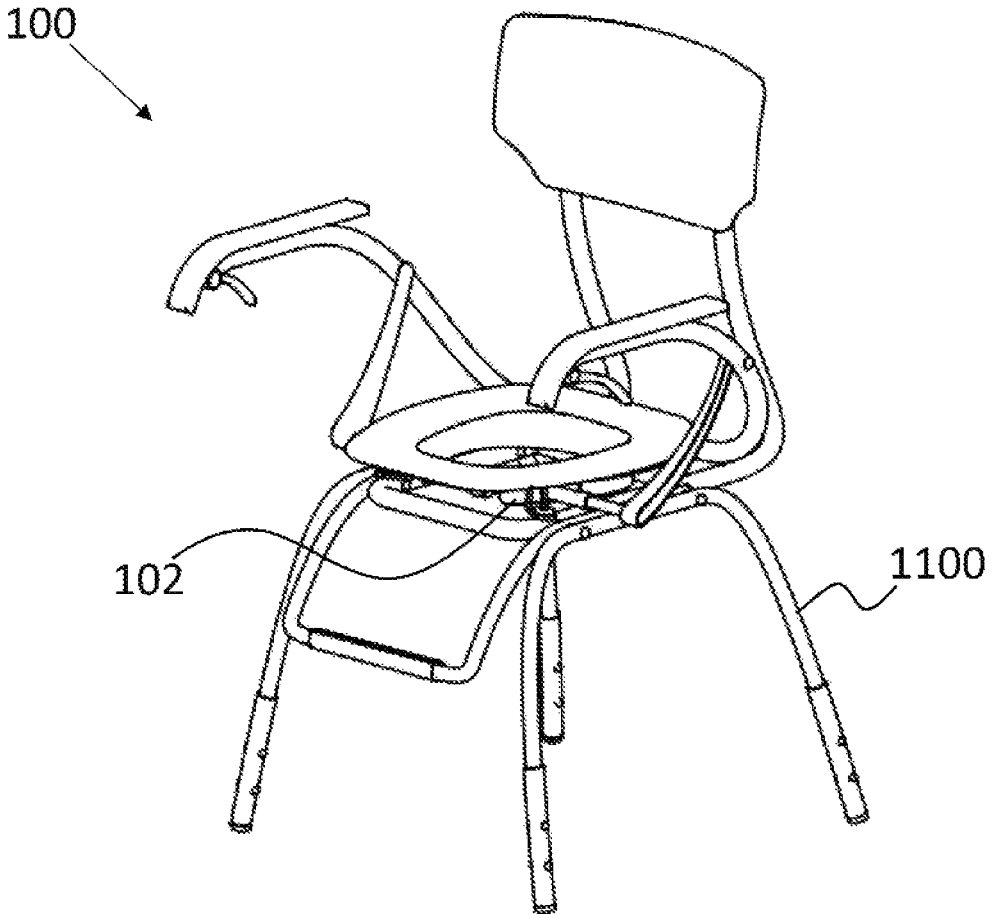
FIG. 11 is an illustration of the seat assist device according to the principles of the present invention, depicting an aspect in which the seat assist device is incorporated into a toilet or commode chair.
Figure 12:
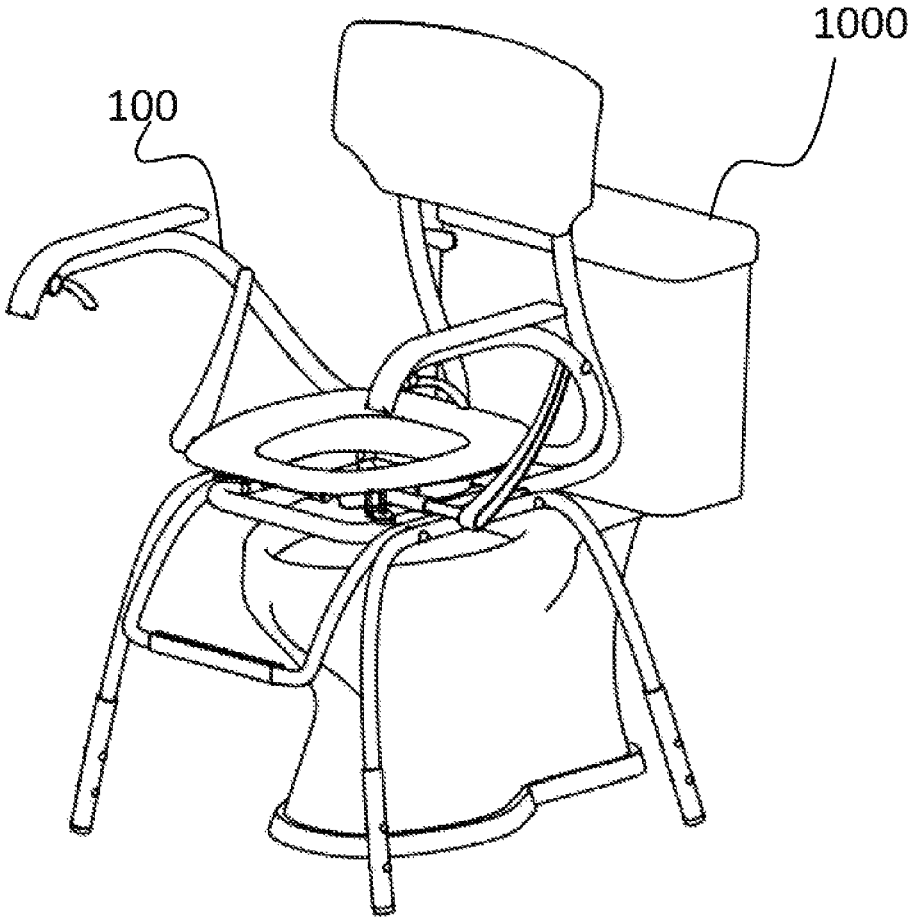
FIG. 12 is an illustration of the seat assist device according to the principles of the present invention, depicting an aspect in which the seat assist device is incorporated into a toilet or commode chair.

As yet another example and as depicted in FIG. 11, the seat assist device 100 can be incorporated into a toilet seat chair that can be positioned over a traditional toilet (or have a commode bowl positioned underneath). This aspect is similar to that as depicted in FIG. 10, except that the base 102 in FIG. 11 includes additional frame members 1100 (e.g., metal tubing, or any other framing component as necessary) to operate as a chair in of itself. For example and as shown in FIG. 12, the seat assist device 100 can operate as a toilet seat chair for positioning over a traditional toilet 1000.

Figure 13:
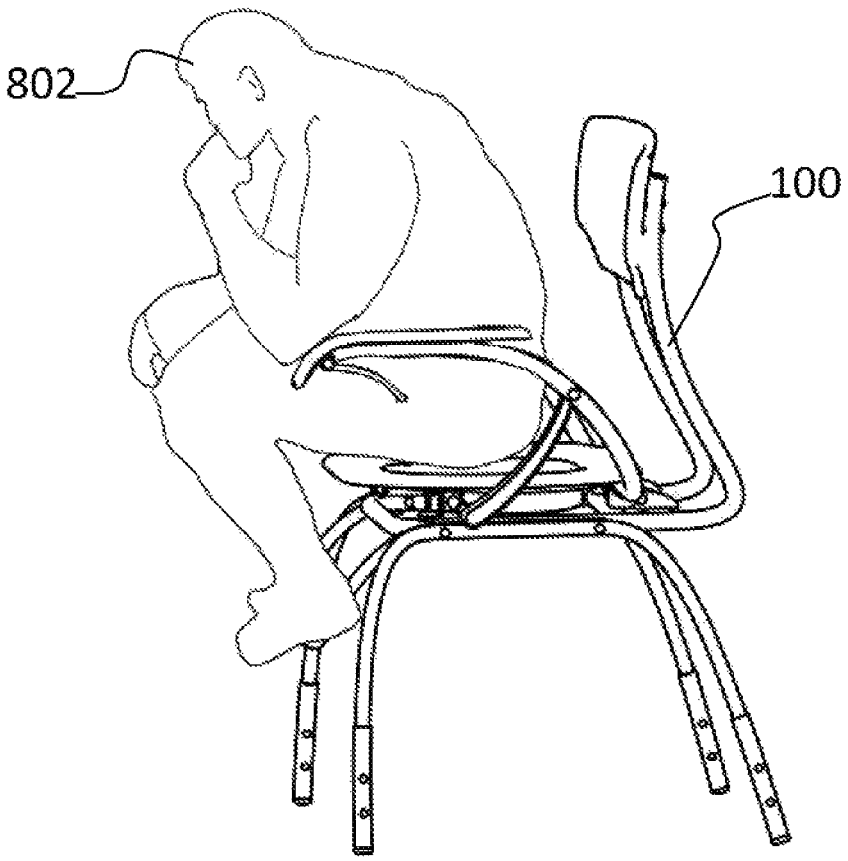
FIG. 13 is an illustration of the seat assist device according to the principles of the present invention, depicting an aspect in which the seat assist device is incorporated into a toilet or commode chair.
Figure 14:
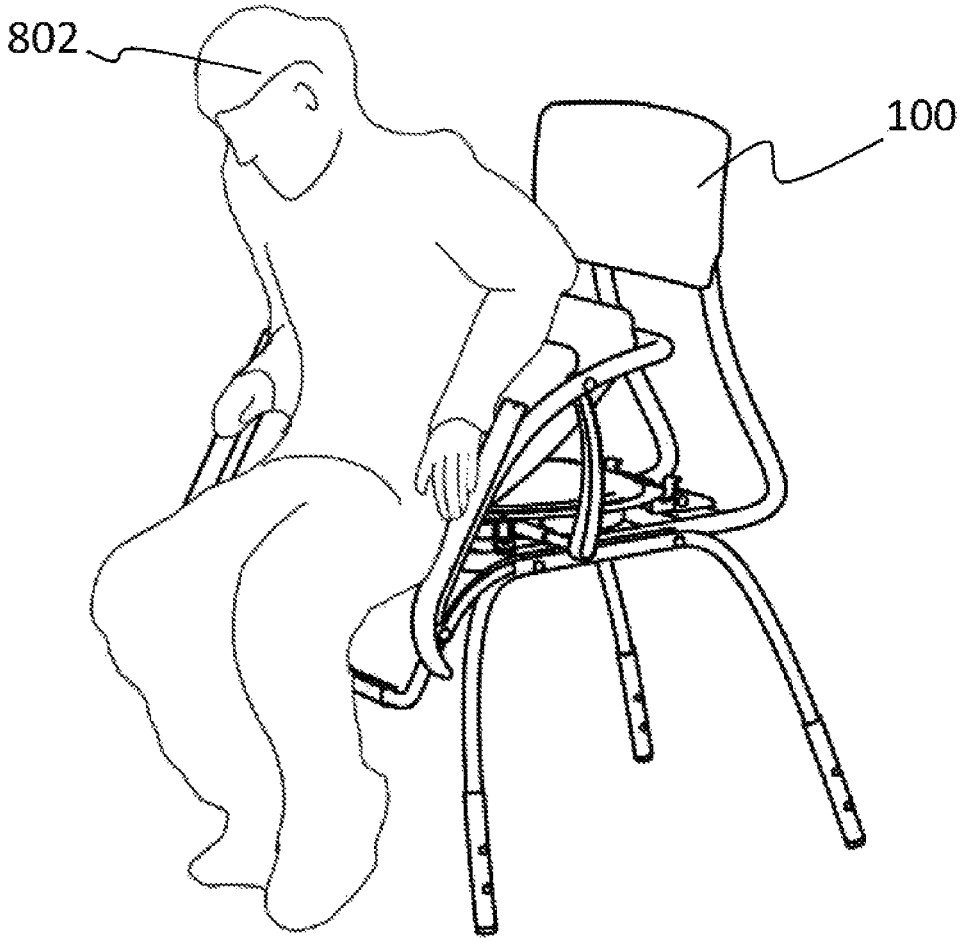
FIG. 14 is an illustration of the seat assist device according to the principles of the present invention, depicting an aspect in which the seat assist device is incorporated into a toilet or commode chair.
Figure 15:
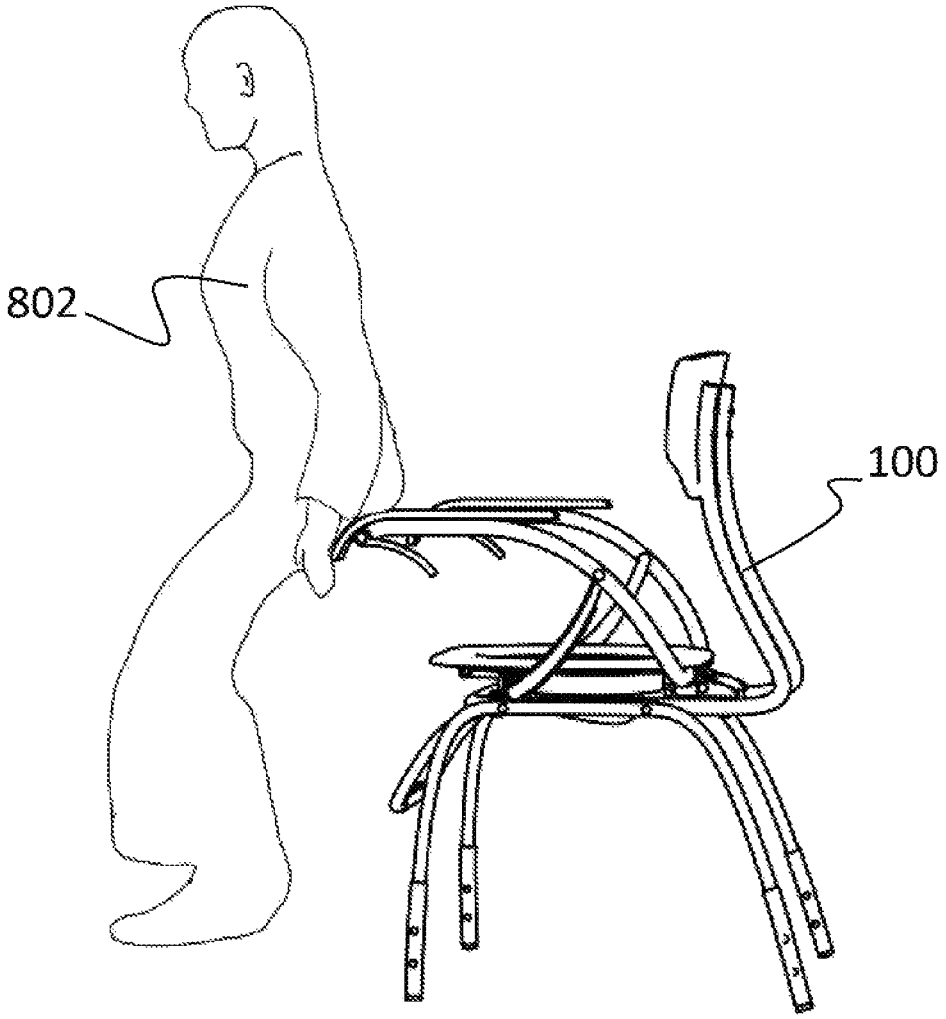
FIG. 15 is an illustration of the seat assist device according to the principles of the present invention, depicting an aspect in which the seat assist device is incorporated into a toilet or commode chair.

For example and as depicted between in FIGS. 13, 14, and 15, the user 802, using the seat assist device 100, can rise from a seated position to a standing position (or lower in the reverse order).

Figure 16:
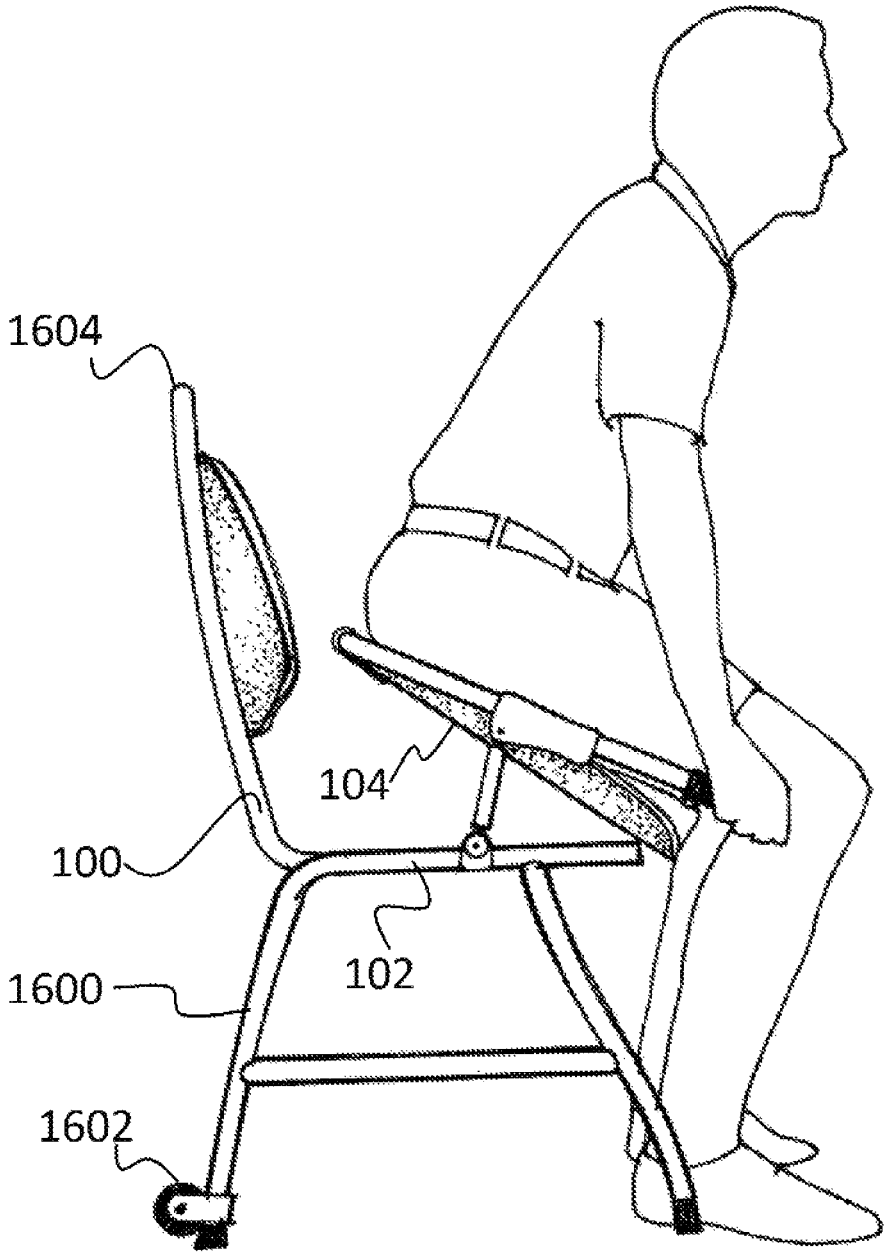
FIG. 16 is an illustration of the seat assist device according to the principles of the present invention, depicting an aspect in which the seat assist device is incorporated into a chair.

Another example of the seat assist device 100 is depicted in FIG. 16. The embodiment depicted in FIG. 16 operates similarly to those aspect as described above; however, the base 102 again includes additional frame members 1600 to form an actual chair in of itself, including legs, a backrest, etc. Thus, in this aspect, the seat assist device 100 is built into the chair. Cushions can be separately formed and attached with the lift platform 104 or the lift platform 104 itself can include seat cushions formed thereon. Also, the chair optionally includes wheels 1602 and a handle 1604, thereby allowing a caregiver or other individual to tilt the chair back and provide mobility to the chair. It should be understood that such a seat assist device 100 can also be built directly into a wheelchair to provide a similar function.

Figure 17:
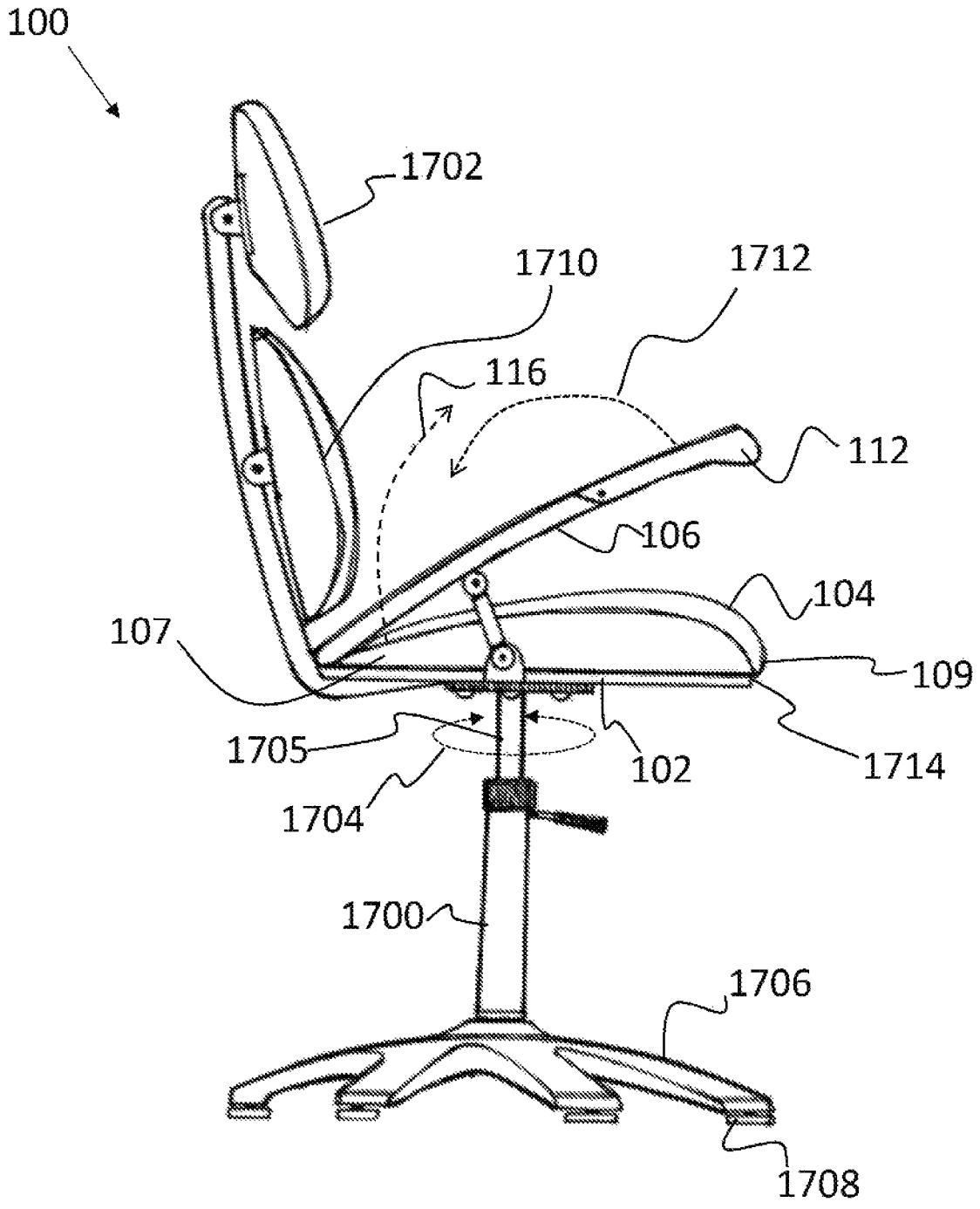
FIG. 17 is an illustration of the seat assist device according to the principles of the present invention, depicting an aspect in which the seat assist device is incorporated into a chair.

Another example of the seat assist device 100 is depicted in FIG. 17, which is directed to a side or dining chair, or office desk chair, etc. The embodiment depicted in FIG. 17 operates similarly to those aspect as described above; however, the base 102 again includes additional frame members 1700 to form an actual chair in of itself, including a leg, backrest, etc. In this aspect, for example, the seat assist device 100 includes a gas piston 1700 that provides for vertical adjustability (similar to a traditional desk chair). Adjustable back supports 1702 can be included, along with a swiveling motion 1704 imparted by the central post 1705. A floor platform 1706 is included for stabilizing the seat assist device 100 on the floor surface. In some embodiments, slides 1708 (as opposed to wheels) are included on a bottom side of the floor platform 1706 for further stability when using the seat assist device 100 to lift oneself. Pockets 1710 can also be included on the back rests to provide for hot or cold packs. When not in use, the handles 112 can be swing out of the way or flipped back 1712 onto the lifting arm 106.

Further, the lift platform 104 operates as a seat upon which a user can comfortably sit. When it is desired to lift oneself, the user can simple press down on the handles 112, which causes the rear portion 107 of the lift platform 104 (i.e., the chair seat) to lift 116 and tilt forward since the front portion 109 of the lift platform 104 is pivotally connected 1714 with the base 102.

Figure 18:
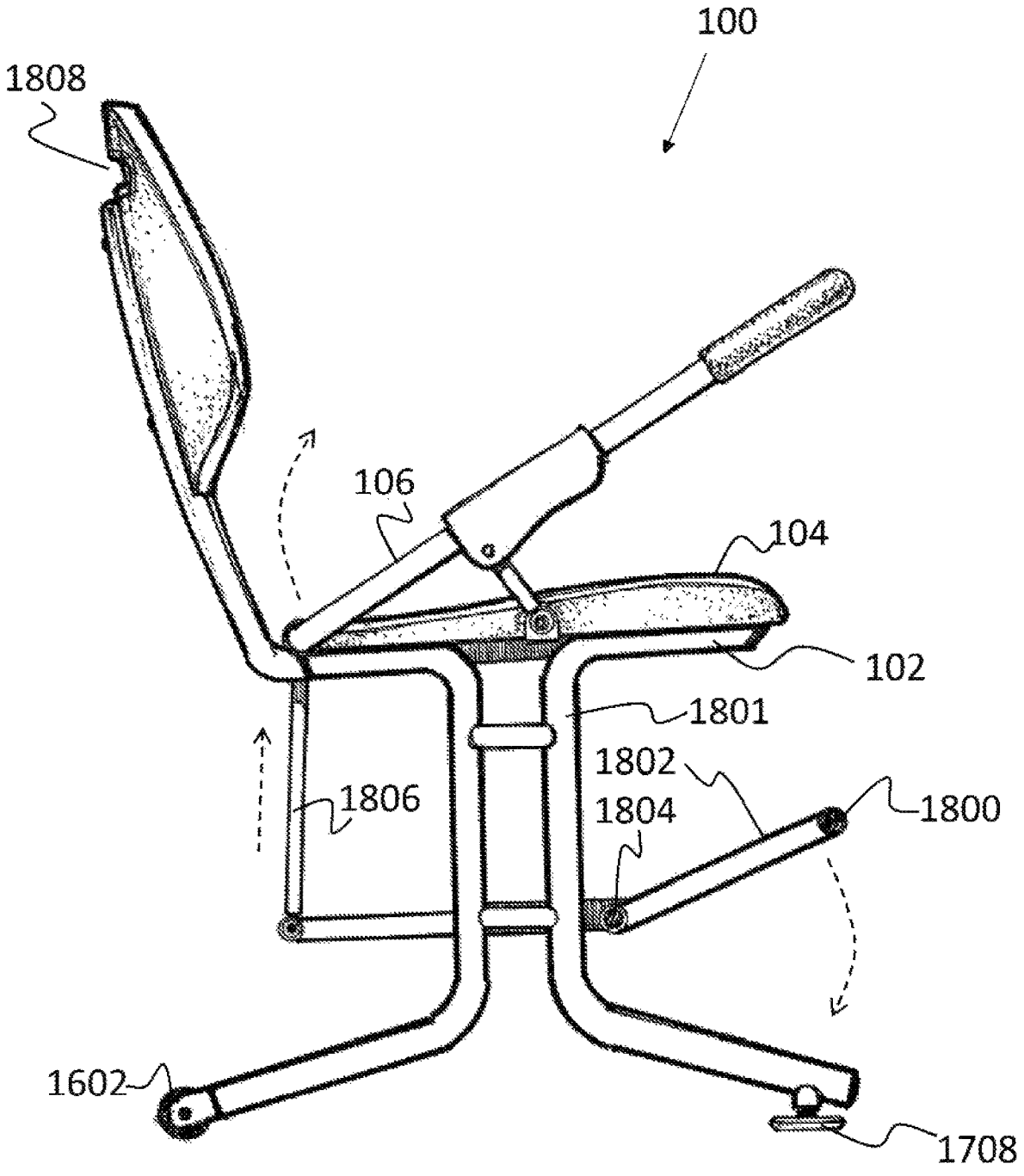
FIG. 18 is an illustration of the seat assist device according to the principles of the present invention, depicting an aspect in which the seat assist device is incorporated into a chair.

Another example of the seat assist device 100 is depicted in FIG. 18, which is directed to a caregiver type device in which another party can depress a foot pedal 1800 to actuate the seat assist device 100. The embodiment depicted in FIG. 18 operates similarly to those aspect as described above; however, the base 102 again includes additional frame members 1801 to form an actual chair in of itself, including a leg, backrest, etc. Additionally, a first linkage 1802 is connected with the foot pedal 1800 that pivots about a pivot point 1804. The first linkage 1802 can be straight or, as depicted, bent to provide additional lift. A lift linkage 1806 is pivotally connected with the first linkage 1802. Desirably, the lift linkage 1806 is also connected with lifting arm 106 (although it can be connected directly with the rear portion of the lift platform 104 (e.g., seat)). Thus, when the foot peddle 1800 is depressed, the first linkage 1802 pivots about the pivot point 1804 to lift the lift linkage 1806, which in turn forces the lift platform 104 to lift (according to the same mechanisms described above and throughout this specification). Optional additions include a hand grip 1808 (or handle) formed in the backrest, along with wheels 1602 and a slide 1708 attached with the chair legs.

Figure 19A:
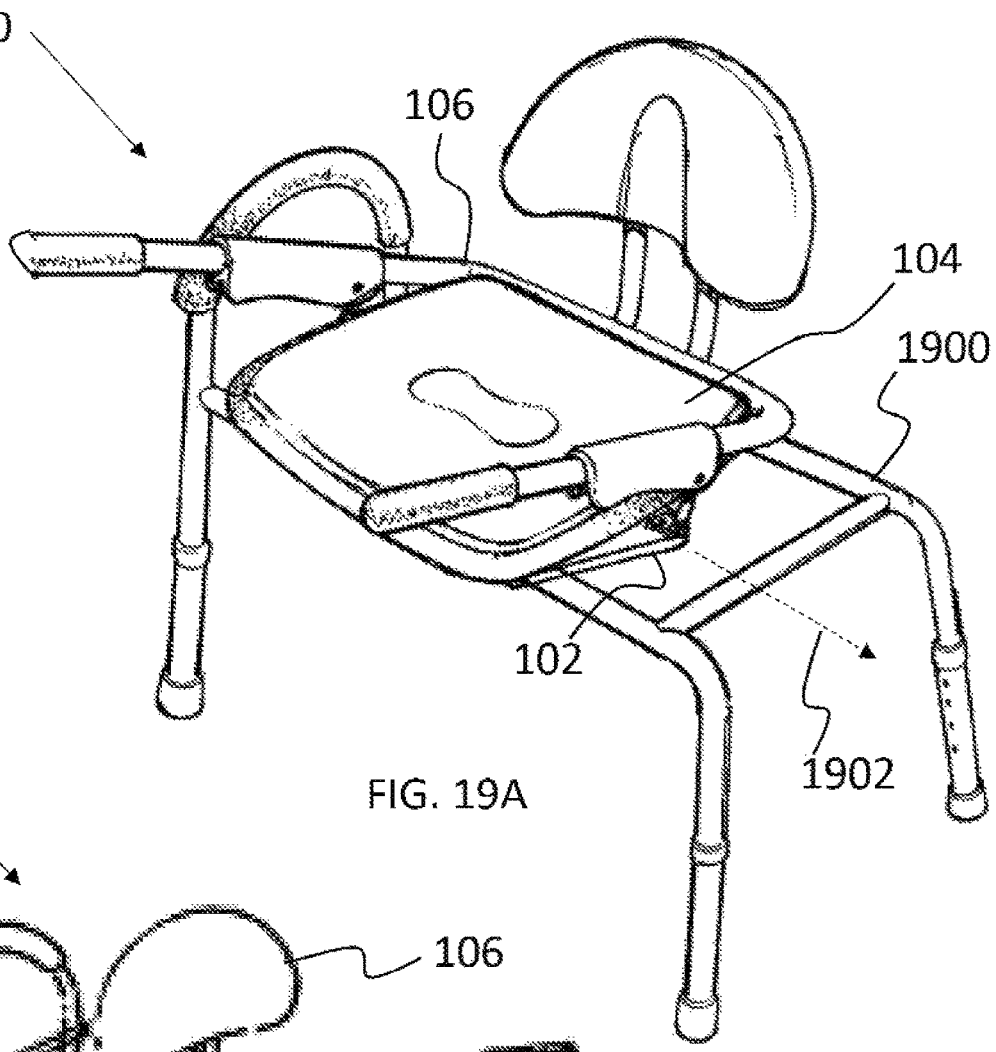
FIG. 19A is an illustration of the seat assist device according to the principles of the present invention, depicting an aspect in which the seat assist device is incorporated into a shower transfer seat.
Figure 19B:
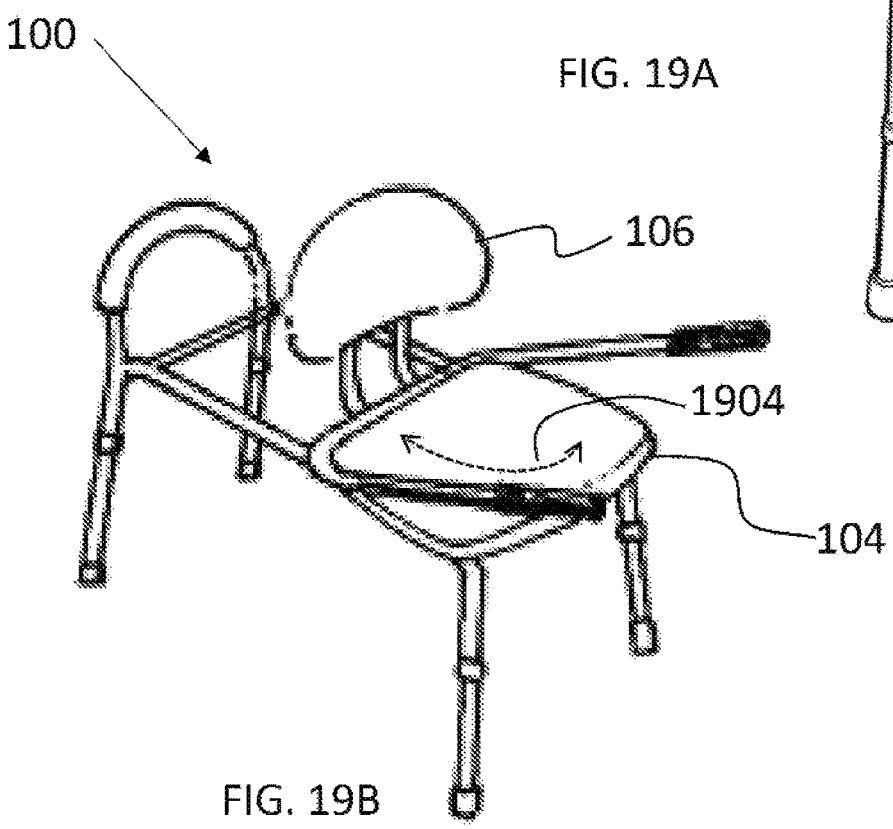
FIG. 19B is an illustration of the seat assist device according to the principles of the present invention, depicting an aspect in which the seat assist device is incorporated into the shower transfer seat.

Another example of the seat assist device 100 is depicted in FIGS. 19A and 19B, which is directed to a shower transfer seat. The embodiment depicted in FIGS. 19A and 19B operate similarly to those aspect as described above; however, the base 102 again includes additional frame members 1900 to form an actual shower transfer seat. In this aspect, the base 102 is slideably connected with the additional frame members 1900 so that it can slide 1902 in out and out a bath or shower. As a non-limiting example, the base 102 includes a platform with a swivel and sleeves that is connected with and between the base 102 and the additional frame members 1900. The sleeves allow the base 102 to slide 1902, while the swivel allows the base to rotate 1904 and, in effect, rotate 1904 the lift platform 104 and lifting arms 106.

While several aspects of the invention have been illustrated and described, it is understood that various modifications might be made. Accordingly, it is understood that the invention is not limited to the disclosed embodiment(s), but rather it is intended to include all embodiments which would be apparent to one skilled in the art and which come within the spirit and scope of the invention.

What is claimed is:

1. A seat assist device, comprising:

a base;

a lift platform having a front portion and a rear portion, with the front portion of the lift platform being pivotally connected with the base;

a lifting arm connected with the rear portion of the lift platform, the lifting arm extending from the lift platform to project beyond the front potion of the lift platform, with the lifting arm terminating in handles for grasping by a user;

a lift bar pivotally connected between the base and the lifting arm such that the lift bar provides a pivot point about which the lifting arm pivots, such that pressing downward on the handles causes the lifting arm to pivot about the lift bar and lift up the rear portion of the lift platform, whereby a user sitting upon the seat assist device can press downward on the handles to cause the rear portion of the lift platform to rise and, in doing so, assist the user in rising from a seated position; and a slide slideably connected with the lifting arm, wherein the lift bar is pivotally connected with the slide, thereby pivotally connecting the lift bar with the lifting arm.

2. The seat assist device as set forth in claim 1, further comprising a limit strap connected with and between the base and lifting arm, the limit strap operable for limiting upward motion of the rear portion of the lift platform.

3. The seat assist device as set forth in claim 2, further comprising pinch guards attached with the base, the pinch guards being positioned proximate the lift bar to prevent fingers from getting pinched between the lift platform and the base.

4. The seat assist device as set forth in claim 3, further comprising a slide stop attached with the lifting arm, the slide stop being a protrusion on the lifting arm to prevent forward motion of the slide.

5. The seat assist device as set forth in claim 4, wherein the slide is slideable between a folded position in which the slide is slid backwards along the lifting arm and a ready position in which the slide is drawn forward as the user lifts the handles.

6. The seat assist device as set forth in claim 5, further comprising a slide lock attaching with the lifting arm, the slide lock being formed to selectively lock the slide in place with respect to the lifting arm.

7. The seat assist device as set forth in claim 6, wherein the lifting arm is pivotally connected with the rear portion of the lift platform via a P-strap hinge.

8. The seat assist device as set forth in claim 7, wherein the lift platform is shaped as a toilet seat.

9. The seat assist device as set forth in claim 8, wherein the base further includes frame members formed to elevate the lift platform and position the lift platform over a toilet.

10. The seat assist device as set forth in claim 1, further comprising a limit strap connected with and between the base and lifting arm, the limit strap operable for limiting upward motion of the rear portion of the lift platform.

11. The seat assist device as set forth in claim 1, further comprising pinch guards attached with the base, the pinch guards being positioned proximate the lift bar to prevent fingers from getting pinched between the lift platform and the base.

12. The seat assist device as set forth in claim 1, further comprising a slide stop attached with the lifting arm, the slide stop being a protrusion on the lifting arm to prevent forward motion of the slide.

13. The seat assist device as set forth in claim 1, wherein the slide is slideable between a folded position in which the slide is slid backwards along the lifting arm and a ready position in which the slide is drawn forward as the user lifts the handles.

14. The seat assist device as set forth in claim 1, further comprising a slide lock attaching with the lifting arm, the slide lock being formed to selectively lock the slide in place with respect to the lifting arm.

15. The seat assist device as set forth in claim 1, wherein the lifting arm is pivotally connected with the rear portion of the lift platform via a P-strap hinge.

16. The seat assist device as set forth in claim 1, wherein the lift platform is shaped as a toilet seat.

17. The seat assist device as set forth in claim 16, wherein the base further includes frame members formed to elevate the lift platform and position the lift platform over a toilet.

* * * * *